United States Patent [19]

Haglund

[11] Patent Number: 4,474,561

[45] Date of Patent: Oct. 2, 1984

[54] WATER JET UNIT

[75] Inventor: Kjell Haglund, Karlstad, Sweden

[73] Assignee: Kamewa AB, Kristinehamn, Sweden

[21] Appl. No.: 322,186

[22] Filed: Nov. 17, 1981

[30] Foreign Application Priority Data

Nov. 26, 1980 [SE] Sweden ..... 8008288

[51] Int. Cl.[3] ..... B63H 11/02

[52] U.S. Cl. ..... 440/41; 440/38; 440/83; 60/221; 308/DIG. 12

[58] Field of Search ..... 440/40, 41, 42, 38, 440/39, 43–47, 83, 112; 60/221, 222; 308/174; 114/DIG. 12, 151

[56] References Cited

U.S. PATENT DOCUMENTS

| | | | |
|---|---|---|---|
| 3,248,876 | 5/1966 | Parsons | 60/222 |
| 3,575,127 | 4/1971 | Wislicenus | 440/47 |
| 3,680,315 | 8/1972 | Aschaver et al. | 440/41 |
| 3,805,731 | 4/1974 | Furst et al. | 440/47 |
| 3,955,493 | 5/1976 | Hany et al. | 308/174 |

FOREIGN PATENT DOCUMENTS

| | | | |
|---|---|---|---|
| 103937 | 8/1979 | Japan | 308/DIG. 12 |

*Primary Examiner*—Trygve M. Blix
*Assistant Examiner*—Stephen P. Avila
*Attorney, Agent, or Firm*—Browdy and Neimark

[57] ABSTRACT

A water jet unit for ships, comprises a propeller pump having a pump housing connected on its inlet side with an inlet channel and on its outlet side with a water-jet directing outlet means. The pump housing has a hub housing which is arranged centrally in the flow path of the water through the pump housing and which is carried by guide vanes extending radially between the wall of the pump housing and the hub housing. The impeller is mounted on the end of a pump shaft extending into the pump housing through the inlet channel and is journalled in the hub housing by means of an axial bearing and a radial bearing. Both bearings are spherical and have a substantially common center.

4 Claims, 3 Drawing Figures

WATER JET UNIT

Figure 1A:
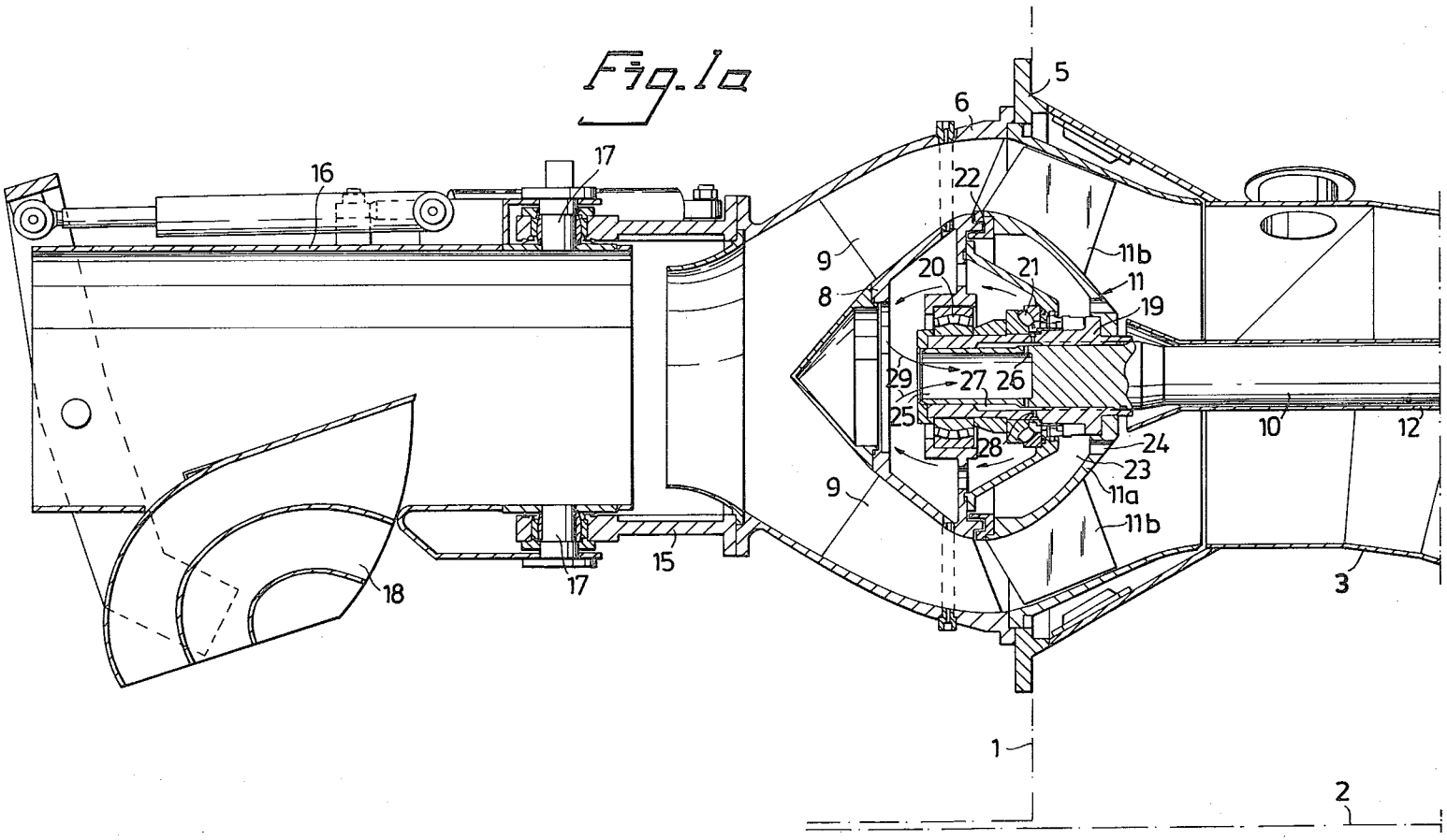

The present invention relates to a water jet unit for ships and is of the kind comprising a propeller having pump housing connected at its water-inlet side to a water-inlet channel and at its outlet side to water-jet directing means. Arranged centrally in the path of the water flow path through the pump housing is a stationary hub housing in which an impeller is journalled on one end of a pump shaft extending through the water-inlet channel. Such water-jet units are known to the art.

One serious problem presented by such water-jet units is the journalling of the pump shaft and the impeller mounted thereon in the pump housing. For example, in order to ensure high pump efficiency, it is necessary for the outer extremities of the impeller blades to pass very closely to the inner surface of the surrounding wall of the pump housing. This means that the bearing in which the impeller and said end of the pump shaft are journalled must be so precise as to exclude the possibility of the impeller blades from contacting the wall of the pump housing. Since the pump shaft extends over a considerable distance from the pump housing to its nearest bearing location within the ship, it is difficult to journal said impeller and the end of said drive shaft in the aforedescribed precise manner, which in turn presents considerable diffculties in positioning the impeller accurately. Further, although the impeller may be accurately positioned initially, this positioning may be disturbed by movement in the actual hull of the ship and as a result of movement of the ship's machinery, which is often resiliently mounted in the ship.

Consequently, an object of the present invention is to provide a water jet unit of the aforedescribed kind in which the bearing in which the impeller and said end of the pump shaft are journalled is so constructed as to prevent the same from being detrimentally affected by deviations of the drive shaft from a theoretical correct position.

To this end there is provided a water jet unit comprising a propeller pump which includes a pump housing having water-inlet means and water-outlet means, a water-inlet channel connected to the water-inlet means of said pump housing, a water-jet directing outlet means connected to the water-outlet means of said pump housing, a stationary hub housing centrally arranged in the flow path of the water through the pump housing, a pump shaft which extends through said inlet channel and into said pump housing, and an impeller which is mounted on the end of the pump shaft located in said pump housing, and which is journalled in the hub housing by means of a spherical axial bearing and a spherical radial bearing having substantially coinciding centres.

In accordance with one embodiment of the invention the water jet unit further comprises a dish-shaped impeller hub attached to said drive shaft; impeller blades carried on the outer surface of said hub; rotatable sealing means arranged on the outer peripheral surface of said hub and facing said hub housing, said sealing means sealing against the hub housing such as to form a space between said hub housing and the impeller hub; and communication means arranged in the impeller hub in the proximity of the pump shaft, for communication of said space with the suction side of the impeller.

According to a further advantageous embodiment, the hub housing is filled with oil, which is circulated in the hub housing by means of the axial bearing.

Figure 1C:
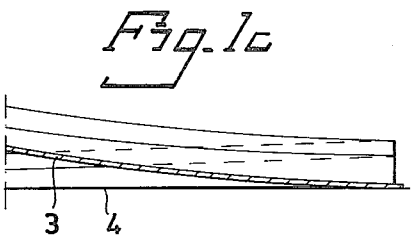
Figure 1B:
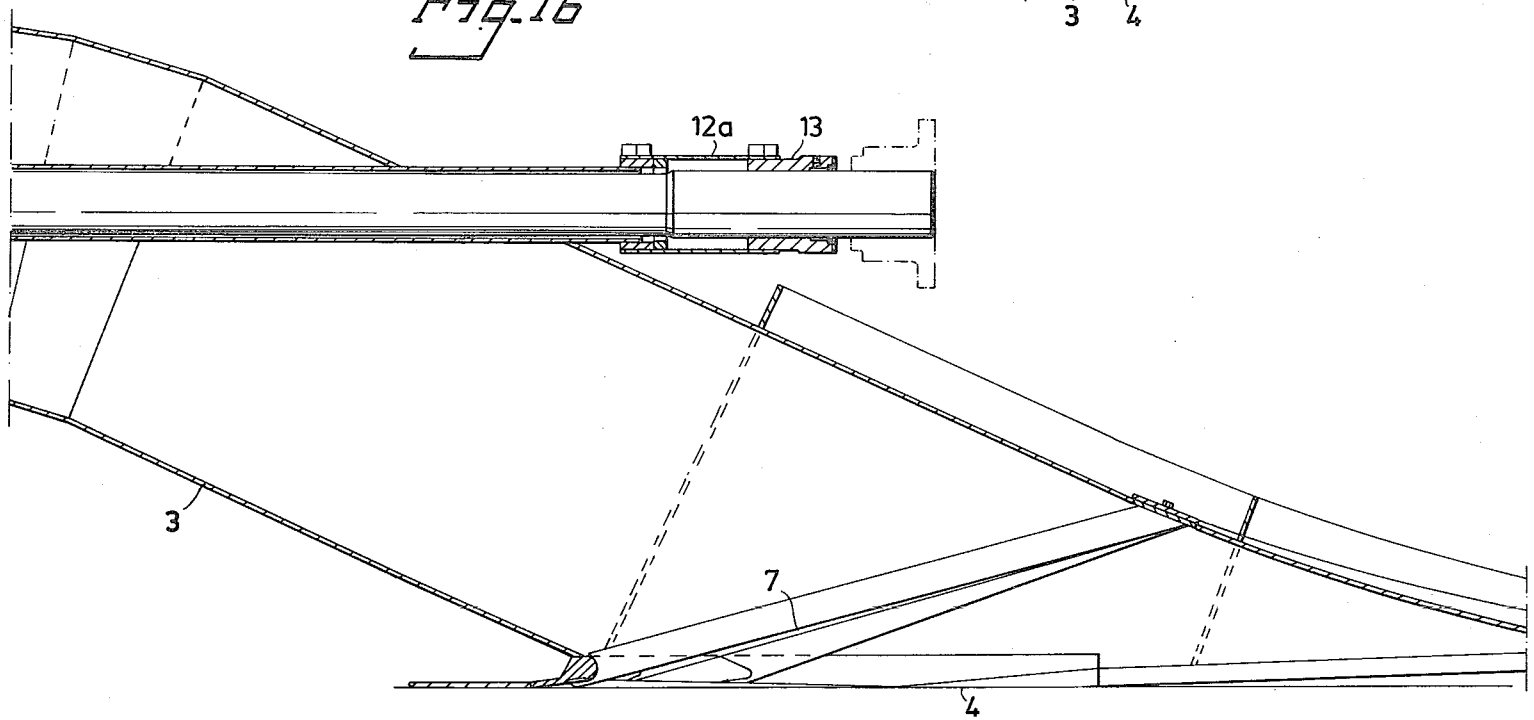

The invention will now be described in more detail with reference to the accompanying drawing, in which:

FIGS. 1*a*, 1*b* and 1*c* when laid end-to-end show a sideview in axial section of an exemplary embodiment of a water jet unit according to the invention.

The water jet unit is shown mounted in the stern of a ship, of which only the transom 1 and the bottom 2 are schematically indicated by chain lines. The water jet unit includes an inlet channel 3, which extends from a water intake 4 located in the bottom of the ship, to the transom 1, where said inlet is connected to a mounting flange 5 for mounting the pump housing 6 of the water jet unit. The intake 4 is provided with a grill 7 which prevents objects which might damage the water jet unit from being drawn thereinto.

The pump is a propeller pump having a hub or bearing housing 8 which is arranged centrally in the path of the flow of water through the pump housing 6 and which is supported by guide vanes 9 which extend between the inner surface of the wall of the pump housing 6 and the outside of the hub housing 8. An impeller 11 mounted on one end of a pump shaft 10 is journalled in the hub housing 8. The pump shaft 10 extends into the pump housing 6 through the inlet channel 3, and is enclosed by a sleeve 12 for reducing the effect of the rotating pump shaft 10 on the flow of the water through the inlet channel 3. The pump shaft 10 is sealed externally of the inlet channel 3 by means of a seal or packing 13, the seal housing of which is connected to the sleeve 12 by means of a flexible sleeve 12*a*, thereby reducing the degree of accuracy to which the inlet channel 3 need be made. The pump shaft 10 is connected to a driving machine or prime mover (not shown) located within the ship.

The pump housing 6 is connected on its outlet side with an outlet pipe 15 in which there is mounted a jet directing nozzle 16. For the purpose of steering the ship, the jet nozzle 16 can be swivelled laterally about vertical pivots 17 by means of hydraulic motors not shown in the drawing. For the purpose of reversing the direction of thrust produced by the unit, so as to retard the speed of the ship or to reverse its direction of movement, a bucket 18 can be progressively swung from an inactive position in which the whole of the water jet from the unit is directed immediately rearwardly for full forward movement into the jet nozzle 16 to a fully inwardly swung maximum, active position in which the whole of the water jet is deflected by means of the bucket 18 obliquely downwardly and forwardly, for full movement rearwards. By adjusting the bucket 18 to intermediate positions between the two said extreme positions, it is possible to deflect a desired part of the water jet so as to obtain a desired forward acting or rearward acting propelling force.

The impeller 11 includes a dish-shaped hub 11*a* which is concave when seen from the hub housing 8 and which carries on its outer surface impeller blades 11*b*. The impeller hub 11*a* is mounted on a sleeve 19, which is mounted on the end of the pump shaft 10 by means of a spline coupling and journalled in the hub housing 8 by means of a radial bearing 20 and an axial bearing 21. Both the radial bearing 20 and the axial bearing 21 are spherical and are so designed and arranged as to have the same center of sphere, whereby the the bearings are substantially unaffected by any deviations of the alignment of the pump shaft 10 from the theoretical, correct alignment. Such deviations can readily occur as a result of inaccuracies when building the hull of the ship and mounting the water jet unit and its prime mover in the ship, and may also occur during operation of the unit, as a result of movement in the ship's hull and of the prime mover, which is often resiliantly mounted in the ship.

For the purpose of reducing the axial load on the impeller 11, the impeller hub 11*a* is provided around its outer periphery with a labyrinth seal 22 which rotates relative to the hub housing 8, so that a space 23 is presented between the hub housing 8 and the impeller hub 11*a*, said space communicating with the suction side of the impeller 11 through openings 24 arranged in said hub in the proximity of the pump shaft.

The interior of the hub housing 8 is filled with lubricating oil under a static overpressure derived from an oil tank located at a higher level than said hub housing. In order to effectively cool the oil in the hub housing 8, the oil is constantly circulated, in that the end of the pump shaft 10 is provided with a bore 25 which communicates, via holes 26, with an annular space 27 between the outside of the shaft 10 and the inside of the sleeve 19, said space 27 communicating in turn with the interior of the axial bearing 21 through holes 28 arranged in the wall of sleeve 19. Oil is circulated within the hub housing 8 by means of the axial bearing 21 as the impeller 11 rotates, as indicated by arrows 29.

While the invention has been described in detail above, it is to be understood that this detailed description is by way of example only, and the protection granted is to be limited only within the spirit of the invention and the scope of the following claims.

I claim:

1. A water jet propulsion device for a water craft, comprising a propeller pump including a pump housing with a water-inlet port and a water-outlet port; a water-intake conduit connected to said water-inlet port of said pump housing; a water-jet directing and discharging means connected to said water-outlet port of said pump housing; a stationary hub housing arranged within said pump housing centrally located in the flow path of water through said pump housing from said water-inlet port to said water-outlet port; a pump drive shaft extending through said water-intake conduit into said pump housing through said water-inlet port thereof and having one end only rotatably supported in said stationary hub housing; a pump impeller mounted on said end of said pump drive shaft; a single spherical axial bearing and a single spherical radial bearing rotatably supporting said end of said pump drive shaft in said hub housing, and said spherical axial bearing and said spherical radial bearing having substantially coinciding spherical center, whereby said shaft can move about a single point defined by said coinciding spherical centers of said single spherical axial bearing and sain single spherical radial bearing.

2. A water jet propulsion device as claimed in claim 1, wherein said pump impeller includes a dish-shaped impeller hub attached to said pump drive shaft; impeller blades carried on the outer surface on said dish-shaped impeller hub; rotatable sealing means arranged along the peripheral edge of said dish-shaped impeller hub and facing said stationary hub housing for rotatably sealing against said hub housing, whereby a space is formed between said stationary hub housing and said dish-shaped impeller hub; and openings provided in said dish-shaped impeller hub in the proximity of said pump drive shaft for forming a communication between said space and the suction side of said impeller.

3. A water jet propulsion device as claimed in claim 1, wherein said stationary hub housing is filled with lubricating oil and and flow paths are provided within said hub housing for circulation of said oil, said flow paths extending through said spherical axial bearing so that the oil is forced to circulate under the action of said spherical axial bearing when said pump drive shaft is being rotated.

4. A water jet propulsion device for a water craft, comprising a propeller pump including a pump housing with a water-inlet port and a water-outlet port; a water-intake conduit connected to said water-inlet port of said pump housing; a water-jet directing and discharging means connected to said water-outlet port of said pump housing; a stationary hub housing arranged within said pump housing centrally located in the flow path of water through said pump housing from said water-inlet port to said water-outlet port; a pump drive shaft extending through said water-intake conduit into said pump housing through said water-inlet port thereof and having its end rotatably supported in said stationary hub housing; a pump impeller mounted on said end of said pump drive shaft; a spherical axial bearing and a spherical radial bearing rotatably supporting said end of said pump drive shaft in said hub housing, said spherical axial bearing and said spherical radial bearing having substantially coinciding centers, wherein said pump impeller includes a dish-shaped impeller hub attached to said pump dirve shaft; impeller blades carried on the outer surface on said dish-shaped impeller hub; rotatable sealing means arranged along the peripheral edge of said dish-shaped impeller hub and facing said stationary hub housing for rotatably sealing against said hub housing, whereby a space is formed between said stationary hub housing and said dish-shaped impeller hub; and openings provided in said dish-shaped impeller hub in the proximity of said pump drive shaft for forming a communication between said space and the suction side of said impeller.

* * * * *